United States Patent [19]

Shaffer

[11] 4,355,560

[45] Oct. 26, 1982

[54] REED CONSTRUCTION

[76] Inventor: David W. Shaffer, 1214 Borden Rd., San Marcos, Calif. 92026

[21] Appl. No.: 187,634

[22] Filed: Sep. 16, 1980

Related U.S. Application Data

[63] Continuation of Ser. No. 47,744, Jun. 12, 1979, abandoned.

[51] Int. Cl.[3] ..... G10D 9/02

[52] U.S. Cl. ..... 84/383 A

[58] Field of Search ..... 84/383 A

[56] References Cited

U.S. PATENT DOCUMENTS

| | | | |
|---|---|---|---|
| 2,919,617 | 1/1960 | Brilhart | 84/383 A |
| 3,759,132 | 9/1973 | Backus | 84/383 A |
| 3,905,268 | 9/1975 | Gamble | 84/383 A |

*Primary Examiner*—Lawrence R. Franklin

*Attorney, Agent, or Firm*—Albert L. Gabriel

[57] ABSTRACT

A reed construction for a musical instrument fabricated from a plurality of fibers combined with a binding agent and a filler material of lower density than the binding agent, so as to produce an acoustic impedance comparable to that of the natural cane reed.

19 Claims, 3 Drawing Figures

REED CONSTRUCTION

This is a continuation of application Ser. No. 47,744, filed June 12, 1979, now abandoned.

BACKGROUND OF THE INVENTION

1. Field of the Invention

The invention is in the field of reed constructions particularly for use on woodwind musical instruments.

2. Description of the Prior Art

It is generally accepted that the natural cane reed is by far the most desirable reed construction for reed instruments including those of the single reed variety such as the clarinets and saxophones as well as the double reed variety such as oboes and bassoons. The selection of high quality reed cane reeds is, however, still considered more of an art than a science. Reeds constructed from natural cane show a great variation in tone quality and playability resulting from variations in density, rigidity and porosity which in turn depends upon such factors as geographical origin of the cane, cultivation and transport-storage conditions. Consistency of tone quality is difficult to achieve even when selecting the top quality cane from the same crop. Even after selection of a reed with acceptable tone quality, repeated absorption of moisture over an extended period of use adversely affects reed playability so that the cane reed must be frequently replaced.

The prior art has long sought to duplicate the tone quality and playability of cane reed in a construction which is more consistently reproducible and more durable. A substantial reduction or elimination of moisture absorption within the reed body has been of prime importance. One such prior art device is a reed made entirely of plastic which is advantageous for its moisture resistance and fabrication simplicity, e.g., a simple molding technique may be used in fabrication. It is generally recognized, however, that the plastic reed falls far short of natural cane in tone quality, resonance, pitch and range.

A widely utilized artificial (non-cane) reed is fabricated from fiber threads and resin and is sold under the name Fibercane distributed by H & A Selmer Company of Elkhart, Ind. Such an artificial reed is described in U.S. Pat. No. 2,919,617 to Brilhart, which teaches the use of a resin impregnated with glass fiber threads forming overlapping blanks which are stacked to form the reed. Other types of fibers may be utilized such as Dacron, nylon or other synthetic or natural fibers. Another prior art structure is shown in U.S. Pat. No. 3,905,268 to Gamble wherein the reed is constructed with arched, transverse cross sections having longitudinal stiffening ribs therein. The reed may be fabricated from glass coupled resin. Although these prior art approaches generally provide a moisture impervious barrier, none of the prior art reed constructions have a tone quality and playability comparable to that of the natural cane reed. In particular, utilization of these prior art devices has resulted in reeds having insufficient strength to sustain vibrations in the high registers. High notes are generally of inferior tonal quality and come off generally flat, and indeed, the entire formant structure is seriously changed because the usual wide spectrum of overtones is missing.

SUMMARY OF THE INVENTION

It is therefore a general object of the invention to provide a substitute for a natural cane reed which overcomes the disadvantages of the prior art.

A more specific object of the invention is to provide a reed construction having the tonal quality and playability of the natural cane reed but being much less susceptible to moisture absorption and saturation thereby improving upon the consistency and durability of the reed. The resulting reed construction has an extended working lifetime in comparison with the cane reed and moreover has a much more stable uniform playing characteristic both during short session playing and over the extended lifetime of the reed itself.

In accordance with the principles of the invention there is provided a reed for a musical instrument comprising a plurality of fibers, a binding agent combined with the fibers for securing same in a substantially uniform random distribution, and a filler material having a density less than the density of the binding agent. The fibers are oriented substantially along the direction of the longitudinal axis of the road. The filler material is embedded approximately uniformly throughout the binding agent in the region between the fibers. The relative proportions of the fiber, binding agent and filler are selected to give the reed an acoustic impedance comparable to the acoustic impedance of natural cane reeds.

A major disadvantage within prior art constructions utilizing various fibers is that the combination of the fiber/binding agent (usually a resinous material) results in a reed of higher density than desired. The high reed density requires an excessive amount of effort to play the instrument if the pitch is to be maintained. It is recognized that the terms desired density and excessive effort are relative terms but these terms have a definite meaning when taken in comparison with the natural cane which is utilized, for its tone quality and playability characteristics, as a model of comparison and emulation. In accordance with the principles of the invention, it is recognized that the most important parameter determinative of the tone quality and playability of the reed is its acoustic impedance which is a function of the ratio of Young's modulus to the density of the reed. Acoustic impedance is in fact determinative of the frequency of oscillation of the reed and may be strictly defined as E/p, where E is Young's modulus, also known as the tensile modulus, and p is density. Young's modulus may be thought of generally as "stiffness" and is defined as the ratio of the tensile stress to the tensile strain. For an elongated body such as a fiber, tensile strain is defined as the ratio of the change in length per unit length, and stress is conventionally defined as the tensile force per unit area exerted on the body. By controlling the ratio of Young's modulus to the density of the material, one can vary the acoustic impedance of the reed itself, and in this manner, bring the acoustic impedance to a value comparable to that of natural cane. It is to be noted that either E nor p need be the same as for cane but the ratio of E/p for the invention must be similar to the ratio for cane.

Although attempts have been made to emulate the tone quality and playability of the cane reed utilizing for example fibers in a resin binding, such devices are typically not sufficient to provide adequate tonal quality particularly in the high frequency registers. If the correct stiffness is obtained, the reed possesses too great a density and therefore provides too much inertia for acceptable play. If the relative proportion of the fiber and resin were adjusted to obtain an acceptable density for the reed, the resulting reed combination is found to be far too soft to provide an adequate reproduction of the complete spectral range particularly in the high registers. In accordance with the invention, the reed composition has been modified from that taught in the prior art by adding a low density filler material to the binding agent, generally a resinous material. The density of the filler is selected most preferably substantially lower than that of the resinous material so as to cut down the overall density of the binding agent (with filler) to the range of about one-third to one-half of the resinous material alone. Most preferably, the filler material is comprised of a plurality of small glass bubbles, an example of which is commonly known as "microspheres" or "microballoons". Inclusion of microballoons as a filler material with the resinous binding agent substantially reduces density of the overall binding agent without adversely affecting any of the binding properties as required for the present application. To this overall binding agent is then added only enough high modulus fibers evenly dispersed throughout the binder to provide just the correct amount of added stiffness. The result is a general improvement in the acoustic impedance of the reed as compared with prior art reeds made with the higher density resin alone or with fibers.

It is thus recognized that an appropriate selection of fiber/binding agent/filler may be advantageously made to have an acoustic impedance comparable to that found in natural cane. It is evident, however, that the acoustic impedance of natural cane is not itself a constant but varies in accordance with the type of cane utilized, its moisture content, age and the like. In consequence, a mean value determined from a large number of high quality natural cane reeds may be used as a standard for acoustic impedance. An acceptable variation about the mean value may typically be on the order of ±16%. This figure is, however, somewhat subjective and may be taken as being a preferred range of acceptability. Within this acceptable range, however, the critical feature in fabricating the artificial reed is to adjust the relative proportion of the fiber, binding agent and filler to achieve an acoustic impedance comparable to that found in natural cane.

BRIEF DESCRIPTION OF THE DRAWINGS

These and other objects of the invention will become clear in reference to the following specification taken in conjunction with the drawings, wherein.

DETAILED DESCRIPTION OF THE PREFERRED EMBODIMENTS

Figure 1:
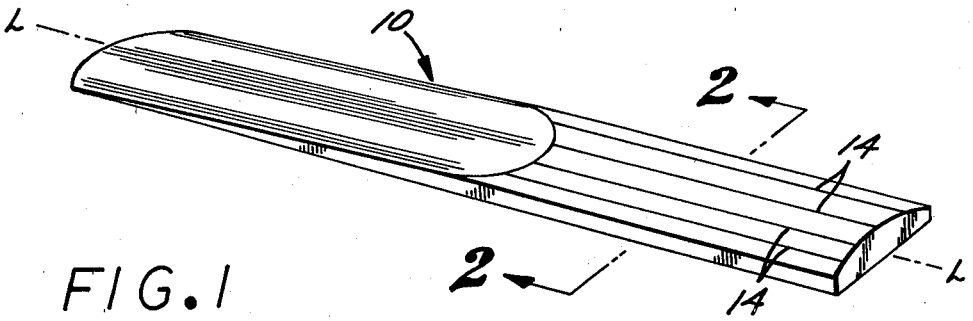
FIG. 1 is a perspective view of a reed fabricated in accordance with the invention and suitable for use in a woodwind musical instrument.

FIG. 1 illustrates a single reed 10 which is made in accordance with the invention. As shown in FIG. 1, the exterior dimensions, e.g., the size and shape of the reed itself are entirely compatible and, in fact, may be identical with the configurations utilized in standard reed constructions. The reed has a longitudinal axis indicated at L. Although FIG. 1 illustrates the general shape of a single reed, it is readily apparent that the invention is equally applicable to double reed constructions as, for example, utilized in such instruments as oboes and bassoons.

Figure 2:
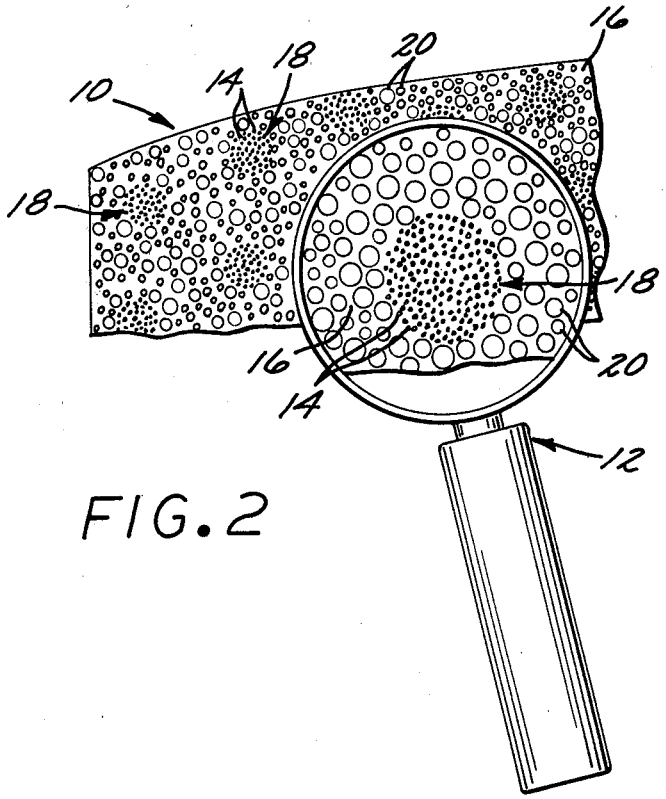
FIG. 2 is a diagrammatic fragmentary cross-sectional view of the reed taken along 2—2 of FIG. 1 and having a portion thereof magnified for clarity of illustration.

FIG. 2 illustrates diagrammatically a partial cross section of the reed 10 of FIG. 1 taken along lines 2—2 thereof. Part of FIG. 2 is shown magnified within the area of magnifier 12 in order to better illustrate the invention. Generally, the reed 10 comprises a plurality of fibers 14 embedded within a binding agent 16 which serves to bind the fibers 14 into a unitary structure forming part of the reed. The binding agent 16 is preferably a resinous material such as an epoxy. The fibers may be strands of S-glass, graphite or any natural or synthetic fiber of sufficient stiffness (modulus) to maintain adequate acoustic impedance, and are preferably aramid fibers such as Kevlar distributed by DuPont. In the case of Kevlar, for example, the fibers 14 are disposed together to form a group or roving indicated generally by the number 18. Positioned between the groups 18 of fibers 14 is a filler material indicated at 20 and shown in the form of microballoons or microspheres. The density of the filler material is substantially lower than that of the resin material which it essentially displaces. The density of the glass bubbles, for example, may be on the order of 0.3 grams per c.c. as compared with a density on the order of four times as large for the resinous material. Fibers 14 are oriented substantially along the direction of the longitudinal axis L of the reed as shown by several fibers 14 proximate the surface of the reed 10 in FIG. 1. As best illustrated in FIG. 2, the fibers are arranged uniformly throughout the reed cross-sectional area in a generally random configuration.

Figure 3:
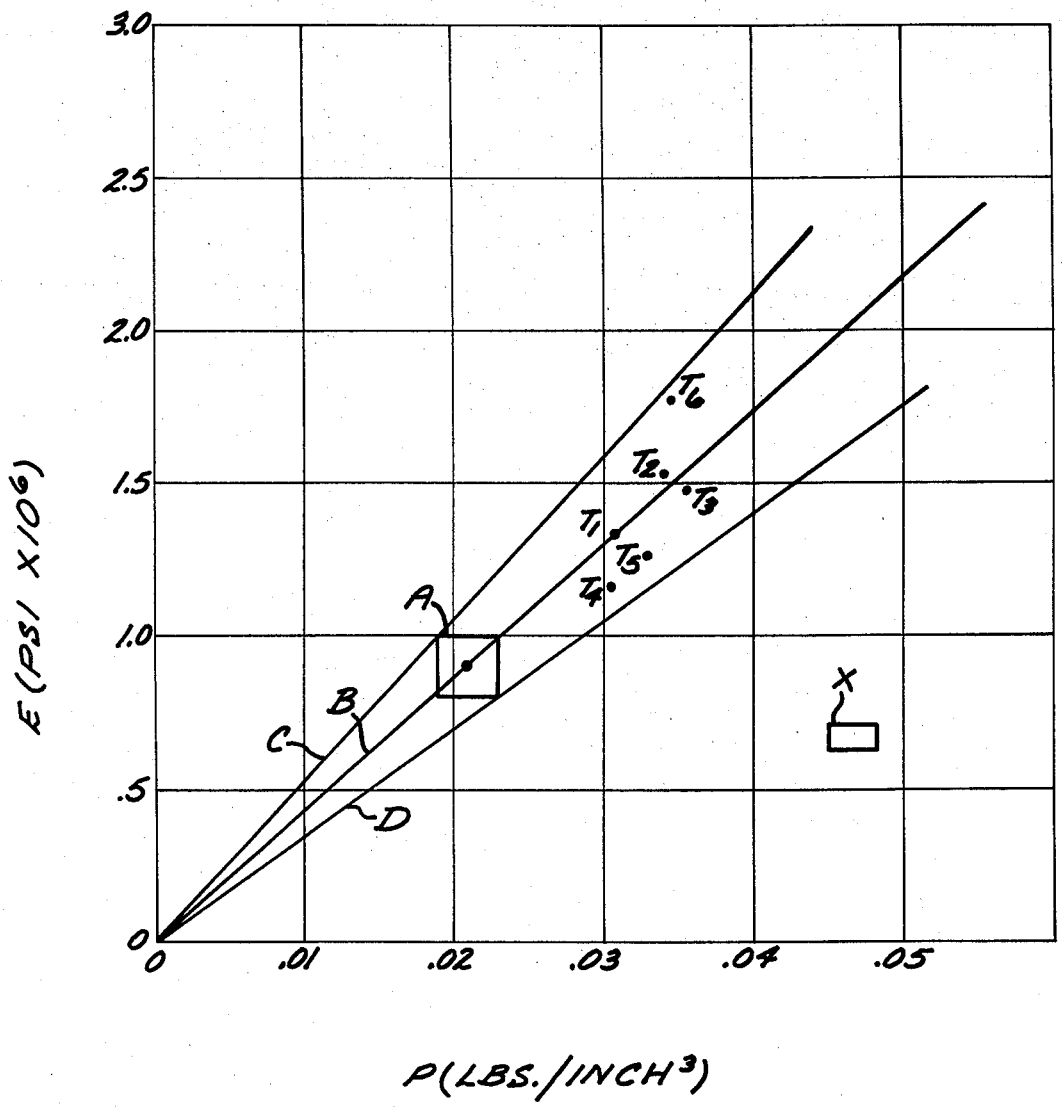
FIG. 3 is a graph illustrating the acoustic properties of cane reeds, prior art, and artificial reeds made in accordance with the invention.

FIG. 3 is a plot illustrating the acoustic impedance of the artificial reed in accordance with the invention. On the ordinate of FIG. 3 is plotted Young's modulus, E, in psi, and on the abscissa is plotted the density of the read in lbs/in$^3$. Thus, FIG. 3 is a plot of E versus p. It is to be understood that "acoustic impedance" as defined for any material is a function only of E/p. Thus, on the plot of FIG. 3, the line B has a slope of E/p equal to E/p for natural cane and all points on that line also have the same value of E/p. Different materials will display the same vibration characteristics (playing ability) if this ratio is the same for the materials.

Represented by the block labeled "A" is the region corresponding to the acoustic impedance of natural cane. The line B drawn through the diagonal of Box A represents the mean value of the E/p ratio for the natural cane reeds. It is this mean value represented by the line B that is important in selecting the relative proportions of fibers 14, binding agent 16 and filler 20. Lines C and D represent lines of constant E/p associated with deviations of ±16% respectively from the mean value of acoustic impedance for natural cane. It has been found that artificial reeds falling within a range of acoustic impedance of approximately ±16% of the mean value of natural cane provide excellent tone quality and playability. Acoustic impedance outside this window may still, however, be acceptable for certain unusual types of use. Various points labeled T1–T6 in FIG. 3 are representative values for the ratio E/p obtained with the present invention. Points T1–T5 all lie within the lines C and D and thus fall within ±16% of the mean value of the acoustic impedance of natural cane reeds. Point T6 falls only slightly outside of the ±16% range. The points T1–T6 are illustrative only and, in accordance with the invention, other points falling generally within the window of lines C and D may result depending upon the particular materials utilized and their relative proportions. Prior art fiber/resin combinations generally fall substantially outside the ±16% window such as illustrated by the block X.

As representative of a specific example, a preferred embodiment of the reed comprises an aramid fiber such as Kevlar for the fibers 14, an epoxy resin for the binding agent 16 and glass microspheres and microballoons for the filler 20. More particularly, the fibers 14 may be fabricated from Kevlar 29 distributed by DuPont Company and having a density on the order of 1.44 grams per cubic centimeter. Kevlar 29 has a tensile strength of $4\times10^5$ psi, tensile modulus of $8.5\times10^6$ psi and a break elongation of about 4%. Most preferably a filament roving of approximately 200 denier is utilized. (A denier is the weight in grams of 9000 meters of the fiber). Kevlar 29 typically is fabricated of multiple, round cross section filaments of about 1.5 denier per filament. The filament diameter is on the order of 12 microns. It may thus be seen that utilizing 200 denier Kevlar 29, each group or roving 18 contains approximately 133 filaments. It is thus understood, that in FIG. 2, the actual number of filaments in the preferred embodiment is much greater than that illustrated.

A number of binding agents 16 may be utilized with the fibers 14, and a suitable example is a medium viscosity liquid epoxy resin under the brand name Araldite 6010, distributed by CIBA Products Company, Summit, N.J. The density of the resin is on the order of 1.2 grams/cc and the elastic modulus is approximately $4\times10^5$ psi. The resin has a tensile strength of approximately 12,000 psi, and a flexural strength of about 15,000 psi. The resin is typically mixed with a hardener, as for example an MDA curing agent, to produce proper curing. A Dow epoxy resin 331 or Shell 828 may also be used with a similar hardener.

The filler material may be a microballoon filler such as glass bubbles manufactured by 3M Company and designated B23/500. The glass bubbles are hollow glass microspheres having an average diameter of approximately 80 microns and a wall thickness on the order of 2 microns. The density of the glass bubbles is approximately 0.3 grams per cc. The glass bubbles may vary in size over a range of approximately 20–130 microns.

Reed examples according to the invention which, when tested, produced the values of points T1–T6 in FIG. 3 were prepared of Kevlar 29, epoxy resin and glass bubbles selected in approximately the following proportions by volume: 13% Kevlar 29; 40% epoxy resin; and 47% glass bubbles. Thus, in accordance with the present invention the relative proportion of the fibers, binding agent and filler is selected to produce a reed composition which has an acoustic impedance comparable to that of natural cane. The E/p ratio of FIG. 3 for the mean value of natural cane is approximately $43\times10^6$ psi/lb/in$^3$. It is this constant value of E/p which will produce a reed most accurately emulating natural cane reeds, and it will be seen in FIG. 3 that the points T1–T6 average to an E/p ratio which closely approximates that of natural cane.

Although the fiber material is preferably made from the Kevlar 29, Kevlar 49 may also be utilized as well as graphite, S-glass or various other natural or synthetic fibers. Kevlar 49 has the same tensile strength as Kevlar 29 but has a tensile modulus of $18\times10^6$ psi and a break elongation of about 2.75%.

A number of binding agents are readily available generally in the form of a resinous material. Polyesters, epoxy and phenolics are representative examples. The microballoons and microspheres may be made from glass bubbles as set forth above or the microballoon effect may be achieved by chemically foaming a gas, such as air into the resinous material achieving an effective reduction in density of the resinous material after curing; in either case forming a synthetic cellular structure which is comparable to the natural cellular structure of the cane reed, being microporous.

The utilization of glass fibers such as S-glass also results in acceptable E/p values since the filler materials substantially reduce the density of the binding/resin combination so as to permit the reed to have sufficient stiffness without the resulting large inertia due to the high density of the S-glass resin combination alone. Kevlar, however, is most advantageous since it is non-toxic and non-irritable and thus not subject to possible abrasive characteristics of glass which are important in the reed embodiment. Kevlar has an additional advantage of folding at the tip of the reed in the manner of cane if pushed against the lip, whereas glass would have a tendency to lacerate the lip. Further, Kevlar has been found most suitable in providing a damping or quieting effect as compared to graphite or glass composition. Kevlar has an unusually high free vibration decay characteristic as compared, for example, to graphite/epoxy or fiberglass/epoxy compositions. Consequently, one may not expect a "ringing" characteristic associated for example, with the fiberglass or more easily recognizable in steel and iron materials. The more highly damped Kevlar requires the reed instrument to be played with a certain uniform pressure which is quite similar to that required for natural cane. For example, the graphite/epoxy loss factor for the decay of free vibrations is on the order of $30\times10^{-4}$ whereas fiberglass/epoxy has a loss factor of $47\times10^{-4}$. In contrast, the combination of Kevlar/epoxy has a loss factor of $160\times10^{-4}$. The high damping characteristics thus give the Kevlar reed a vibrational characteristic similar to that of natural cane.

In fabricating the reed, the glass microballoons may first be mixed with the resinous material, and then the mixture applied to successive layers of fibers. As illustrated in FIG. 2, the microballoons are typically of a size too large to impregnate the rovings 18 although they will substantially uniformly fill the region between the rovings. The resinous material will generally, however, permeate through the roving 18 and thus serve to bind the individual filaments together within the rovings as well as the rovings within the reed body. The cured reed may be cut to a conventional shape.

It is noted that in relation to prior art artificial reeds, the number of fibers per unit volume is considerably less with the reed having acceptable E/p ratios, and the amount of resin-filler considerably greater. Kevlar, for example, has a very high tensile modulus and consequently it is necessary to utilize a low stiffness, low density resin filler. If pure resin were utilized the density of the reed would be too high which is a common problem in prior art designs. Utilizing the filler enables a lower overall density thus enabling the E/p ratio to fall on the desired line within acceptable limits. Thus, most prior art compositions utilize 60%–70% fiber material by volume which maximize the amount of fiber in relation to the resin binder. Typical ranges of volume fiber percentages in accordance with the invention are 5%–35%, particularly when Kevlar is used.

A distinct advantage in accordance with the teachings of the invention is the repeatibility of the acoustic impedance in fabricating the reed in contradistinction to an essentially uncontrollable variation of impedance from natural cane reeds. More generally, the particular acoustic impedance of the artificial reed may be selected with the same consistency so as to achieve emphasis of desired spectral ranges, a feature heretofore not possible except by mere happenstance in utilizing natural cane.

Another advantage in utilizing reeds made in accordance with the invention is the particular vibrant quality of sound produced so that the instrument has an extended range heretofore not available in prior art artificial reeds. The instrument feels particularly "alive" in comparison with the much more sullen and dead feeling of prior art artificial reed constructions.

While the invention has been described with reference to preferred embodiments, modifications may readily be made by those skilled in the art, and it is intended that the claims cover any such modifications which fall within the spirit and scope of the invention.

I claim:

1. A reed for a musical instrument, said reed having a longitudinal axis and comprising:

a plurality of fiber means oriented substantially longitudinally of said reed and arranged in generally uniformly spaced-apart relationship cross-sectionally of said reed;

binding means combined with said fiber means for securing same, said fiber means having a modulus of elasticity that is greater than that of said binding means; and filler means substantially uniformly dispersed in said binding means in regions between said fiber means, said filler means having a density less than the density of the binding means;

said fiber means, binding means and filler means having relative proportions selected to produce an acoustic impedance of said reed at least comparable to the acoustic impedance of natural cane.

2. A reed as recited in claim 1 wherein said filler means provides a cellular structure in said binding means.

3. A reed as recited in claim 1 wherein said filler means comprises microballoon material.

4. A reed as recited in claim 1 wherein said filler means comprises gas bubbles foamed into said binding agent.

5. A reed as recited in claim 1 wherein said fibers comprise aramid fiber means.

6. A reed as recited in claim 5 wherein said fiber means comprise Kevlar 29.

7. A reed as recited in claim 1 wherein each of said fiber means comprises a group of closely related fibers.

8. A reed as recited in claim 7 wherein said groups are impregnated with said binding means.

9. A reed as recited in claim 8 wherein said fibers comprise aramid fibers.

10. A reed as recited in claim 9 wherein said fibers comprise Kevlar 29.

11. A reed as recited in claim 1, 5 or 6 wherein said binding means comprises resinous material.

12. A reed as recited in claim 1, 5 or 6 wherein said binding means comprises epoxy.

13. A reed as recited in claim 5 or 6 wherein said filler means comprises microballon material.

14. A reed as recited in claim 1, wherein said fiber means comprise aramid fibers, said binding means comprises resinous material and said filler means comprises microballoon material.

15. A reed as recited in claim 1 wherein said fiber means comprises glass.

16. A reed as recited in claim 1 wherein said fiber means comprises graphite.

17. A reed as recited in claim 1, 5 or 6 wherein said binding means comprises polyester.

18. A reed as recited in claim 1 wherein said reed acoustic impedance is a function of E/p wherein E is Young's modulus and p is density, and E/p for natural cane reed is approximately $43\times10^6$ psi/lb/in$^3$.

19. A reed as recited in claim 18 wherein the value of E/p of said reed is selected to fall within about ±16% of $43\times10^6$ psi/lb/in$^3$.

* * * * *